United States Patent [19]

Ballard et al.

[11] Patent Number: 4,789,330

[45] Date of Patent: Dec. 6, 1988

[54] GAS FURNACE CONTROL SYSTEM

[75] Inventors: Gary W. Ballard, Indianapolis; Daniel J. Dempsey, Carmel, both of Ind.

[73] Assignee: Carrier Corporation, Syracuse, N.Y.

[21] Appl. No.: 156,056

[22] Filed: Feb. 16, 1988

[51] Int. Cl.[4] ..... F24H 3/00

[52] U.S. Cl. ..... 431/75; 110/162; 126/116 A; 236/9 R

[58] Field of Search ..... 431/75, 26, 20; 110/162; 126/110 C, 116 A; 236/9

[56] References Cited

U.S. PATENT DOCUMENTS 2,352,143 6/1944 Wills ..... 431/75 X 3,765,820 10/1973 Ito et al. ..... 431/75

4,403,942 9/1983 Copenhaver ..... 126/116 A X 4,688,547 8/1987 Ballard et al. ..... 126/116 A

*Primary Examiner*—William E. Wayner

*Attorney, Agent, or Firm*—Dana F. Bigelow

[57] ABSTRACT

The control system of an induced draft furnace includes a provision for turning on the inducer motor when a flame is sensed outside of the normal sequence of a heating operation. In particular, if the thermostat is in the off position when a flame is sensed, the inducer motor is turned on to ensure that sufficient combustion air is provided to the burner so as to forestall the occurrence of flame roll outs in the event that the gas valve is stuck in a closed position.

9 Claims, 2 Drawing Sheets

L1
L2
43
41
45
32
46
47
36
BLWR
LO/HI
42
LO
HI
LO
MED LO
MED HI
HI
COM
C
BLUM
48
44
COM
49
HSIR
37
HSI
33
IDR
38
34
IDM
120VAC
TRAN
24VAC
54
39
59
56
LOT
61
LS
58
HUMR
57
R
W
63
80
ALS
DSS
81
82
PRS
NO
64
84
87
88
89
91
HSIR
IDR
BLWR
HUMR
LO
HI
MGVR
86
77
CPO
62
MGVR
83
MGV
79
71
66
Y
72
67
76
G
74
73
69
68
FSE
C
78

ENTER TEST FOR STUCK OPEN GAS VALVE

92
IS FLAME SENSED ?
NO
YES
94
IS THERE SUPPOSED TO BE A FLAME AT THIS TIME ?
YES
93
RESET TIMER
NO
95
HAS TIMER STARTED ?
NO
96
START ONE SECOND TIMER
YES
98
97
HAS TIMER COMPLETED ?
YES
TURN OFF GAS VALVE AND IGNITOR. TURN INDUCER MOTOR ON.
NO
EXIT TO MAIN ROUTINE

GAS FURNACE CONTROL SYSTEM

BACKGROUND OF THE INVENTION

This invention relates generally to gas fired furnaces and, more particularly, to a method and apparatus for controlling a gas furnace having a gas valve which is susceptible to being stuck in the open position.

Furnaces may be either of the natural draft or the power draft types. In the power draft furnace, a motor driven blower is operated to motively draw (induced) or blow (forced) the combustion air to the burner to thereby enhance the combustion process. A normal sequence of operation when the thermostat calls for heat is for the inducer motor to come on to purge the system of any gases that might be present. An ignitor is then turned on and a gas valve is opened to initiate the combustion process. A flame sensor circuit then operates to ensure that the burner is operating properly, and then the circulating air blower is turned on to force the heated air into the room. When the room is heated to the point where the thermostat setting is satisfied, the thermostat is turned off, and the gas valve and inducer motor are turned off. After a predetermined delay, the blower is then turned off.

In existing systems, if the gas valve should stick in the open position during a heating cycle and thereby remain open when the room thermostat turns off, the gas will continue to flow and remain ignited even though the inducer motor will be turned off as a function of the normal sequence. Without combustion air being supplied by the inducer, the combustion process will be inhibited and a build up of gas will result. This may in turn cause an undesirable flame roll out with possible resulting damage to the furnace.

It is therefore an object of the present invention to provide an improved control system for an induced, gas fired furnace.

Another object of the present invention is the provision in a gas furnace for reducing the occurrence of flame roll outs.

Yet another object of the present invention is the provision in a gas furnace having a gas valve which is susceptible to sticking in the open position, for reducing the occurrence of flame roll outs.

Still another object of the present invention is the provision in a gas furnace for reducing the occurrence of gas build up when the gas valve sticks in the open position.

Another object of the present invention is the provision in an induced draft, gas furnace for a control system which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, if a flame is sensed at the burner at a time other than when a flame should exist in the normal sequence of operation, the control system is prompted to turn on the inducer motor. This will, in turn, ensure that combustion air is being received at the burner and that a gas rich condition does not occur. In this way, the chance of flame roll outs occurring will be substantially decreased.

By another aspect of the invention, the control system operates to turn on the inducer motor if, at a time when the thermostat is in the open position, the existence of a flame is detected at the burner. The inducer motor is then caused to continue to operate so long as the flame continues to be sensed. If the valve then continues to be stuck in the open position, a limit switch will eventually be caused to open and the circulating air blower will automatically be turned on. The heat in the room will then continue to rise until an observer recognizes that a malfunction has occurred and that corrective action must be taken.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
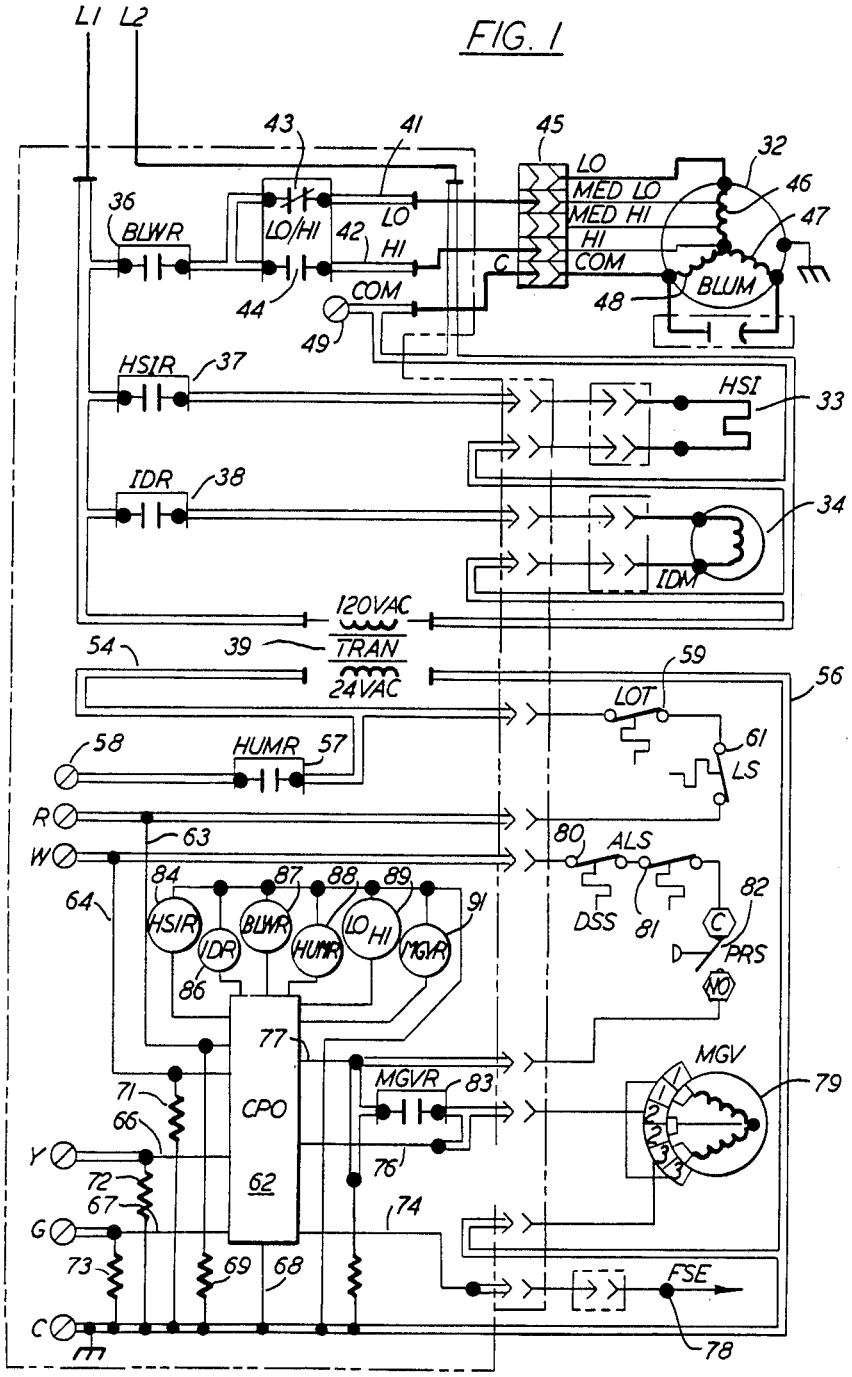
FIG. 1 is a schematic illustration of a furnace control system having the present invention incorporated therein.

Referring now to FIG. 1, the various components of an induced draft gas furnace are shown together with their controlling circuitry which is adapted to operate in accordance with the present invention. A circuit board, indicated by the broken lines, is provided with line voltage by way of leads L1 and L2. Power is thereby provided to a circulating air blower motor 32, a hot surface igniter 33, and an induced draft blower motor 34 by way of relays 36, 37 and 38, respectively. Power is also provided to the control portion of the circuit board by way of a low voltage stepdown transformer 39.

Included in the circuit supplying power to the blower motor 32, in addition to the rely 36, are parallel leads 41 and 42 which provide for low and high speed connections, respectively, and a single pole, double throw relay with the low speed lead 41 having normally closed relay contacts 43 and the high speed lead 42 having normally open relay contacts 44. Both the low speed lead 41 and the high speed lead 42 are connected by way of a five circuit connector 45 to one leg 46 of the Wye connected blower motor 32, with the other legs 47 and 48 being connected via the connector 45 to a common terminal 49. Thus, by selectively choosing the desired connector 45 terminals to be used, and by controlling the relay contacts 43 and 44, the blower motor 32 can be selectively caused to operate at either of the selected levels of low or high speeds.

Referring now to the control or bottom portion of the circuit, low voltage power is provided from the secondary coil of the transformer 39 to the conductor 54 and to the conductor 56, which is connected to the common terminal C. The conductor 54 is electrically connected through normally open relay contacts 57 to a terminal 58 which can be connected to provide power to auxiliary equipment such as a humidifier (not shown), and also to a circuit which includes a manually resettable limit switch 59 sensitive to overtemperature, an automatic resettable limit switch 61 sensitive to overtemperature, and the terminal R.

In addition to the conventional connections as discussed hereinabove, the R, W, Y, G, and C terminals of the circuit board 31 are connected in a conventional manner to the room thermostat (not shown). However, unlike the conventional circuit without microprocessor control, each of those terminals is connected to a microprocessor 62 by way of leads 63, 64, 66, 67, and 68, respectively. Load resistors 69, 71, 72 and 73 are provided between the common terminal C and the respective terminals R, W, Y and G to increase the current flow through the circuits to thereby prevent the occurrence of dry contacts.

Other inputs to the microprocessor 62 are provided along lines 74, 76 and 77. The line 74 is connected to a flame sensing electrode 78 to provide a signal to the microprocessor to indicate when a flame has been proven to exist. Lines 76 and 77 provide other indications as will be discussed hereinafter.

Power to the main gas valve 79 is received from the terminal W by way of a draft safeguard switch 80, an auxiliary limit switch 81, a pressure switch 82 and the normally open relay 83. The microprocessor 62 is made aware of the condition of the auxiliary limit switch 81 and the pressure switch 82 by way of signals received along line 77. The line 76 is connected to the output of the relay 83 and provides voltage level signals to indicate to the microprocessor 62, whether the gas valve should be on or off.

Having described the circuits that are controlled by the microprocessor 62 through the use of relays, the controlling outputs of the microprocessor 62 will now be briefly described. The hot surface ignitor output 84 operates to close the relay contacts 37 to activate the hot surface igniter 33. The inducer motor output 86 operates to close the relay contacts 38 to activate the inducer motor 34. The blower motor output 87 operates to close the relay contacts 36 to activate the blower motor 32. The humidifier output 88 operates to close the relay contacts 57 to activate the humidifier. The low/high relay output 89 operates to open the relay contacts 43 and close the relay contacts 44 to switch the blower motor 32 from low to high speed operation. Finally, the main gas valve output 91 operates to close the relay contacts 83 to open the main gas valve 79.

Considering now the operation of the control apparatus during a typical heating cycle, the sequence of operation will be as follows. When the wall thermostat calls for heat, the R and W circuits are closed. The microprocessor 62 checks the inputs and outputs and energizes the inducer relay 38 to start the inducer motor 34 and initiate the process of purging the system of unwanted gas. As the inducer motor 34 comes up to speed, the pressure switch 82 closes, and after a predetermined period of time, the microprocessor 62 activates the hot surface ignitor relay 37 to provide power to the hot surface ignitor 33. After a warmup period of a predetermined time, the microprocessor 62 activates the main gas valve relay 83 to provide power to and turn on the main gas valve 79. As soon as a flame is sensed by the flame sensing electrode 78, the microprocessor 62 deactivates the hot surface ignitor 37, and holds the main gas valve on so long as the flame is present or until the thermostat is satisfied. When the thermostat is satisfied, the R and W circuits are de-energized to thereby de-energize the main gas valve 79, and, after a post-purge period, the inducer motor 74.

Assume now that the thermostat has called for heat and that the system has responsively cycled through the steps of turning on the inducer motor 34, activating the hot surface ignitor 33, activating the main gas valve relay 83 to turn on the main gas valve 79, and deactivating the hot surface ignitor 37 in response to the presence of a flame being sensed by the flame sensing electrode 78. Subsequently, when the thermostat is satisfied, the R and W circuits are de-energized to thereby deactivate the main gas valve relay 83, which in turn should act to turn the gas valve 79 off. Then, after a post-purge period, the inducer motor should be turned off. However, if the main gas valve 79 is stuck in the open position, even though the power thereto has been turned off by opening of the relay contacts 83, then the gas will continue to flow and a flame will continue to burn, but only under undesirable conditions of possible flame rollout since the inducer motor will have been turned off. The apparatus of the present invention is therefore designed to correct this condition as shown in FIG. 2.

Figure 2:
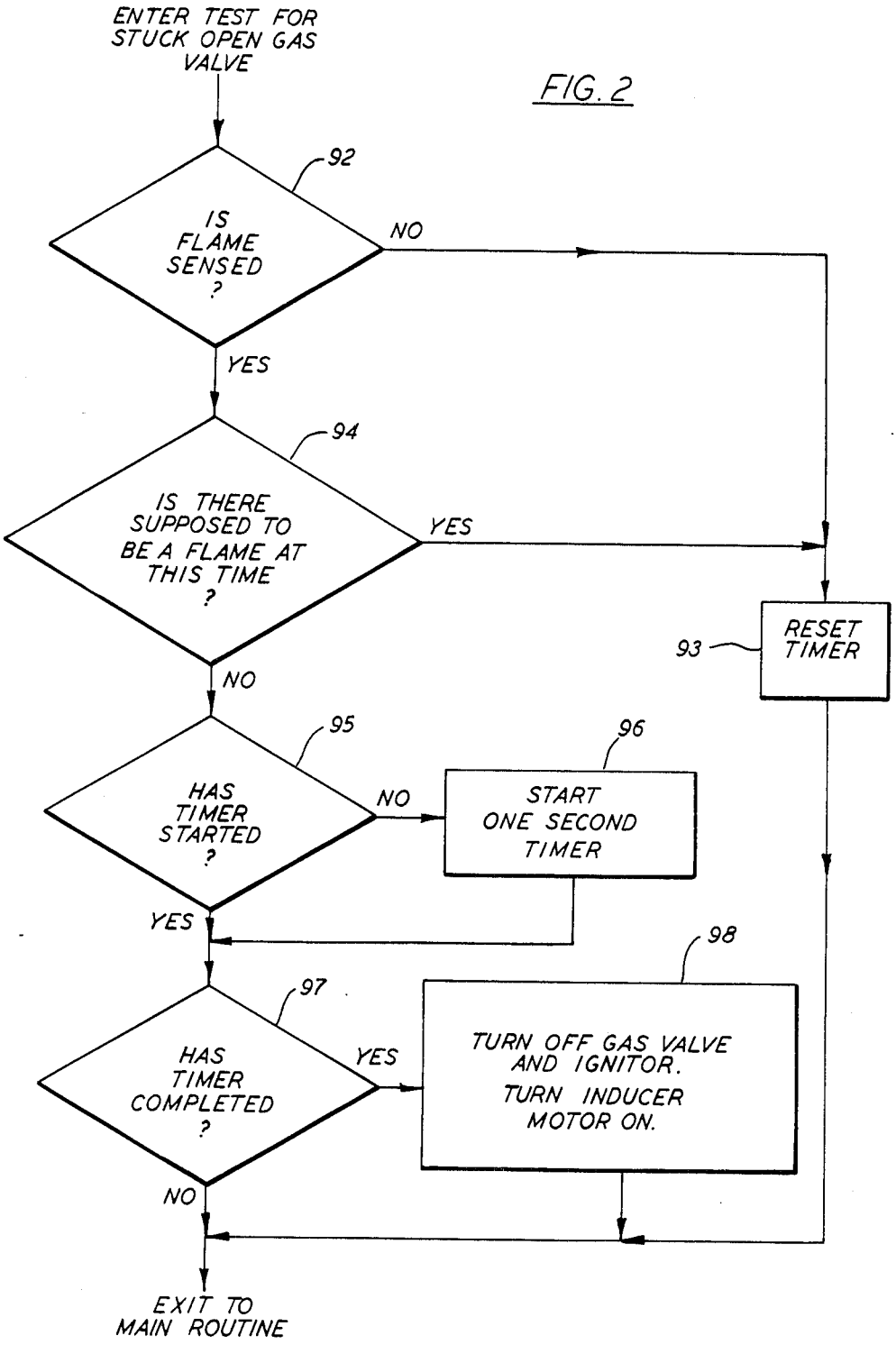
FIG. 2 is a flow diagram showing the operation of the present invention.

If the gas valve 79 does in fact close as intended when the gas valve relay 83 is opened, then the flame will be extinguished and the step indicated in block 92 of FIG. 2 will result in a negative response. The program will then move on to reset the timer, as indicated in block 93, and then the main routine will be resumed. If, however, the gas valve 79 is stuck in the open position, then a flame will be sensed and the control system proceeds to block 94 to query whether there should be a flame at that time. This determination can be made, for example, by determining whether the system is operating in the heating mode routine (i.e. is the thermostat in fact calling for heat). Another query that can be made is whether the gas valve 83 is energized. This is accomplished by way of line 76 which provides to the microprocessor 62 an indication of the voltage level across the relay 83. Thus, if the thermostat is indeed calling for heat and the relay 83 is energized, then the program proceeds to block 93 to reset the timer and then returns to the main routine.

If it is determined that the thermostat is not calling for heat, or that the gas valve relay 83 is in the open position, then the program steps to blocks 95 and 96 to provide a one second delay to allow the relay contacts to open if the system is indeed operating properly. Once that delay period has been provided as indicated by block 97, then the system proceeds to block 98 wherein the microprocessor initiates the proper signals to turn off the gas valve and ignitor and, more importantly, to turn the inducer motor on. If the gas valve is stuck in the open position, the ignitor will most likely be in the off position and the gas valve relay 83 will be in the open position, such that no change occurs to the ignitor or the gas valve. But in the normal operational routine, the inducer motor will have been turned off. Thus, the step of turning on the inducer motor as specified in block 98 will allow the combustion process to proceed with sufficient air so as to prevent flame rollout. The gas valve 79 will then remain in the open position, and the combustion process will continue even though the thermostat setting has been satisfied. A limit switch will eventually then be caused to open and the circulating air blower 32 will be turned on to circulate the air into the room. An occupant in the room will eventually recognize that the temperature has exceeded the set temperature and will be able to take action to correct the matter While the present invention has been disclosed with particular reference to a preferred embodiment, the concepts of this invention are readily adaptable to other embodiments, and those skilled in the art may vary the structure and method thereof without departing from the essential spirit of the present invention.

What is claimed is:

1. In an induced draft furnace of the type having a thermostat and a flame sensor for sensing the existence of a flame at a burner, an improved method of controlling the operation thereof comprising the steps of:

sensing when the thermostat is not calling for heat;

sensing whether, at the same time, a flame exists at the burner; and if a flame exists when the thermostat is not calling for heat, turning on the inducer motor to thereby ensure that combustion air is provided to the burner.

2. A method as set forth in claim 1 and including the step of leaving the inducer motor on so long as a flame exists.

3. In a furnace which is controlled by initiating a predetermined normal heating sequence of operations including the sensing of the existence of a flame at a burner, an improved control method including the steps of:

sensing when a flame exists at the burner;

determining whether the existence of the flame at that time is consistent with the predetermined normal heating sequence; and if it is not, then inhibiting any further operation within said normal sequence.

4. A method as set forth in claim 3 wherein said furnace is an induced draft furnace and wherein the method includes the step of turning on the inducer motor when the existence of the flame is not consistent with said predetermined normal heating sequence.

5. In a gas furnace system of the type which operates in response to a thermostat and which include an inducer for providing combustion air to a burner, a gas valve and delivery system for delivering gas to the burner, a flame sensor for sensing the existence of a flame at the burner, and a control system for automatically cycling the operation of those components in a predetermined heating sequence, an improved method of controlling the system comprising the steps of:

continuously sensing for the existence of a flame at the burner, and refraining from further cycling through said predetermined heating sequence if a flame is sensed outside of said predetermined heating sequence.

6. The method as set forth in claim 5 wherein said gas furnace is of the induced draft type having an inducer and wherein the method includes the step of turning on the inducer when a flame is sensed outside of said predetermined heating sequence.

7. An improved control system for a gas fired furnace of the type having an induced draft blower for providing combustion air to a burner in response to established thermostat conditions, a gas valve which is operable to selectively provide gas to the burner, and a flame sensing device for sensing when a flame exists at the burner, comprising:

sequencing means for selectively turning on and off, in response to said thermostat conditions, various components including the induced draft blower and gas valve, in a predetermined sequence of operations;

discrimination means for providing an indication when a flame is sensed at a time which is not in accord with said predetermined sequence of operations; and activation means for turning on the induced draft blower when said discrimination means provides such an indication.

8. A control system as set forth in claim 1 wherein said predetermined sequence of operations includes the sequential steps of closing the gas valve after the thermostat is opened to conclude a heating cycle.

9. A control system as set forth in claim 7 wherein said predetermined sequence of operation includes the sequential steps of sensing a flame after the gas valve is opened when commencing a heating cycle.

* * * * *